US009359168B1

(12) United States Patent
Moll et al.

(10) Patent No.: US 9,359,168 B1
(45) Date of Patent: Jun. 7, 2016

(54) STORAGE APPARATUS FOR CLEANING LANCE

(71) Applicants: Frank Joseph Moll, Canton, OH (US); Terry Lee Crock, Massillon, OH (US)

(72) Inventors: Frank Joseph Moll, Canton, OH (US); Terry Lee Crock, Massillon, OH (US)

(73) Assignee: HYDROCHEM LLC, Atlanta, GA (US)

( * ) Notice: Subject to any disclaimer, the term of this patent is extended or adjusted under 35 U.S.C. 154(b) by 0 days.

(21) Appl. No.: 13/968,592

(22) Filed: Aug. 16, 2013

Related U.S. Application Data

(60) Provisional application No. 61/684,343, filed on Aug. 17, 2012.

(51) Int. Cl.
*B65H 75/44* (2006.01)

(52) U.S. Cl.
CPC ..... *B65H 75/4481* (2013.01); *B65H 75/4402* (2013.01); *B65H 75/4428* (2013.01); *B65H 75/4471* (2013.01); *B08B 2203/0276* (2013.01); *B65H 2701/33* (2013.01)

(58) Field of Classification Search
CPC ..... B65H 75/4402; B65H 75/4405; B65H 75/4407; B65H 75/4471; B65H 2701/33; B65H 75/4481; B08B 2203/0276
USPC ..... 239/195, 197, 198; 137/355.12, 355.16, 137/355.17
See application file for complete search history.

(56) References Cited

U.S. PATENT DOCUMENTS

| | | | | |
|---|---|---|---|---|
| 4,649,954 | A * | 3/1987 | Dunwoody | 137/355.17 |
| 5,366,023 | A * | 11/1994 | Souza | 171/10 |
| 6,009,956 | A * | 1/2000 | Krieg | 172/438 |
| 7,533,847 | B2 * | 5/2009 | VeRost | 242/594.5 |
| 7,921,871 | B2 * | 4/2011 | Lawrence | 137/355.23 |
| 8,096,317 | B2 * | 1/2012 | Uffner et al. | 137/355.2 |

* cited by examiner

*Primary Examiner* — Ryan Reis
(74) *Attorney, Agent, or Firm* — Greenberg Traurig LLP

(57) ABSTRACT

A storage apparatus for one or more cleaning lances is provided. The storage apparatus can be utilized in connection with a driving apparatus that controls the cleaning movements of a cleaning lance with respect to certain industrial equipment such as a heat exchanger. The driving apparatus can be utilized to feed an additional length of the cleaning lance to the tubes of exchanger or to retract the cleaning lance from the tubes of the exchanger. The storing apparatus can be utilized to store the cleaning lance, regulate the distribution and movement of the cleaning lance, and prevent tangling or snagging of the cleaning lance during the cleaning process.

4 Claims, 10 Drawing Sheets

STORAGE APPARATUS FOR CLEANING LANCE

CROSS REFERENCE TO RELATED APPLICATIONS

This application claims the benefit and priority benefit of U.S. Provisional Patent Application Ser. No. 61/684,343, filed Aug. 17, 2012, titled "Storage Apparatus For Cleaning Lance," the disclosure of which is incorporated herein in its entirety.

BACKGROUND

1. Field of Invention

This subject matter relates generally to the cleaning of industrial equipment, and more particularly, to an apparatus for storing and for regulating and controlling the movement of one or more lances for cleaning heat exchangers, piping, tubing and other equipment found in industrial facilities.

2. Description of the Related Art

Heat exchangers are used in industrial facilities. Over time, these heat exchangers tend to develop residue on the surfaces of the tubes, tube sheets, tube support plates and other internal structural parts. This residue can have an adverse effect on the operational performance of the exchangers. The same problem can arise for piping, tubing and other equipment found in industrial facilities. A cleaning method for this equipment involves the controlled application of high pressure water and/or chemical streams to the affected areas of the equipment. One or more cleaning lances can be utilized to supply the high pressure water and/or chemical streams to the equipment. It is desired to have an apparatus for storing these lances and for regulating and controlling the movement of these lances.

SUMMARY

The following presents a simplified summary of the disclosed subject matter in order to provide a basic understanding of some aspects of the subject matter disclosed herein. This summary is not an exhaustive overview of the technology disclosed herein.

In accordance with the illustrative embodiments hereinafter described, an apparatus for storing a cleaning lance is provided. In an illustrative embodiment, the apparatus can include an enclosure, an aperture formed in the enclosure and sized such that the cleaning lance is passable through the aperture, a spool disposed within the enclosure and operatingly connected to the enclosure for rotation of the spool about an axis, the spool having a rim with at least one channel formed therein for holding the cleaning lance, a contact surface on the rim of the spool, and an engagement wheel disposed adjacent to the spool with a contact surface for contacting the contact surface on the rim of the spool and applying frictional force to the spool upon rotational movement of the spool. In an illustrative embodiment, the engagement wheel can be adjustable between an elevated position and a lowered position, whereby the contact surface of the engagement wheel contacts the contact surface of the rim of the spool when the engagement wheel is in the lowered position and the spool rotates in one direction to wind the cleaning lance onto the spool, and the contact surface of the engagement wheel does not contact the contact surface of the rim of the spool when the engagement wheel is in the raised position and the spool rotates in another direction to unwind the cleaning lance from the spool. In another illustrative embodiment, the engagement wheel can be adjustable between a lowered position where the contact surface of the engagement wheel contacts the contact surface of the rim and drives the spool to rotate and wind the cleaning lance onto the spool, and an elevated position where the contact surface of the engagement wheel does not contact the contact surface of the rim.

In accordance with the illustrative embodiments hereinafter described, a system for retracting a cleaning lance away from a heat exchanger is also provided. The system can comprise a cleaning lance, a storage apparatus and a driving apparatus. The storage apparatus for storing the cleaning lance can comprise an enclosure, a spool disposed within the enclosure and rotatable about an axis, the spool having a rim with a contact surface formed thereon for holding the cleaning lance, an aperture formed in the enclosure and sized such that a segment of the cleaning lance is passable through the aperture, and a motorized engagement wheel disposed adjacent to the spool with a contact surface thereon for contacting the contact surface on the rim of the spool and applying frictional force to the spool to rotate the spool about the axis. The driving apparatus can be motorized and can advance the cleaning lance in the direction of the storage apparatus.

In accordance with the illustrative embodiments hereinafter described, a method of retracting a cleaning lance is also provided. According to these illustrative embodiments, a spool can be provided that is capable of rotational movement. The spool can have a rim with a contact surface. An engagement wheel can be provided that is capable of rotational movement. The engagement wheel can have a contact surface. Upon rotational movement of the spool, the contact surface of the rim of the spool can contact the contact surface of the engagement wheel to apply frictional force to the contact surface of the rim of the spool and can grip the contact surface of the rim of the spool as the cleaning lance is wrapped around the spool. The rotational movement of the spool can be continued even after there is a restriction to movement of the cleaning lance, such that the contact surface of the rim of the spool can slip against the contact surface of the engagement wheel. Once the restriction to movement of the cleaning lance is removed or substantially removed, frictional force can continue to be applied to the spool upon rotational movement of the spool such that the contact surface of the engagement wheel can regrip the contact surface of the rim of the spool and the cleaning lance is further wrapped onto the spool.

In accordance with the illustrative embodiments hereinafter described, a method of retracting a cleaning lance is also provided. A spool can be provided that is capable of rotational movement. The spool can have a rim and a contact surface. An engagement wheel can be provided that is capable of rotational movement. The engagement wheel can have a contact surface. The cleaning lance can be advanced towards the spool, and the contact surface of the spool can be contacted with the contact surface of the engagement wheel to apply frictional force to the contact surface of the spool such that the contact surface of the engagement wheel grips the contact surface of the spool and causes rotational movement of the spool. The cleaning lance can be disposed onto the spool. The rotational movement of the engagement wheel can be continued while there is a restriction to movement of the cleaning lance towards the spool, such that the contact surface of the engagement wheel slips against the contact surface of the spool. The restriction to movement of the cleaning lance can be removed or substantially removed. Frictional force can be applied to the contact surface of the spool with the engagement wheel such that the contact surface of the engagement wheel regrips the contact surface of the spool, and the cleaning lance can be further disposed onto the spool.

BRIEF DESCRIPTION OF THE DRAWINGS

A better understanding of the presently disclosed subject matter can be obtained when the following detailed description is considered in conjunction with the following drawings, wherein.

While certain preferred illustrative embodiments will be described herein, it will be understood that this description is not intended to limit the subject matter to those embodiments. On the contrary, it is intended to cover all alternatives, modifications, and equivalents, as may be included within the spirit and scope of the subject matter defined by the appended claims.

DETAILED DESCRIPTION

The presently disclosed subject matter relates generally to the cleaning of industrial equipment, and more particularly, to an apparatus and method for storing and for regulating and controlling the movement of one or more lances for cleaning heat exchangers, piping, tubing and other equipment found in industrial facilities. The subject matter is described more fully hereinafter with reference to the accompanying drawings in which embodiments of the apparatus and method are shown. The apparatus and method may, however, be embodied in many different forms and should not be construed as limited to the embodiments set forth herein; rather, these embodiments are provided so that this disclosure will be thorough and complete, and will fully convey the scope of the apparatus and method to those of ordinary skill in the art.

Figure 1:
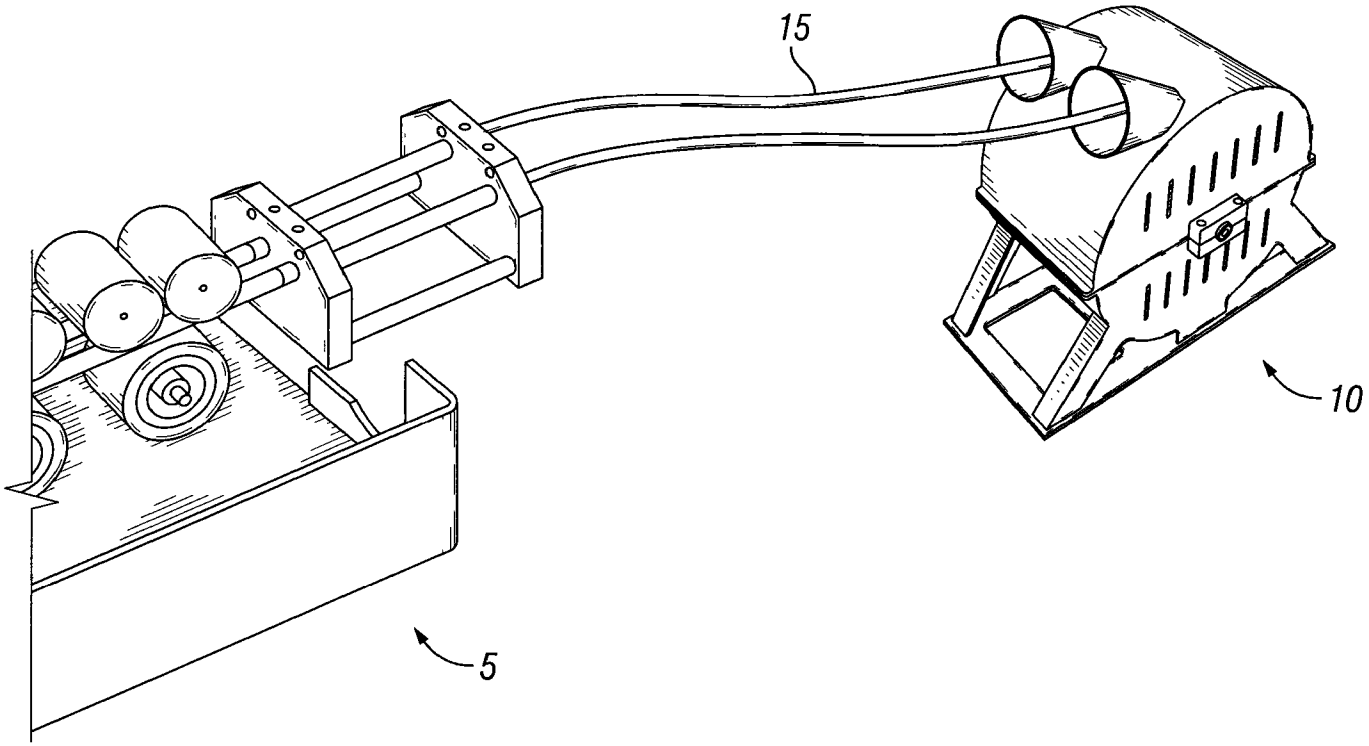
FIG. 1 is a front perspective view of a driving apparatus and storage apparatus used to clean heat exchanger tubes in an illustrative embodiment.

Referring now to FIGS. 1-11, illustrative embodiments of a storage apparatus 10 for one or more cleaning lances 15 is provided. In certain of the illustrative embodiments, for example, as shown in FIG. 1, storage apparatus 10 can be utilized in connection with a driving apparatus 5 that controls the cleaning movements of cleaning lances 15 with respect to certain industrial equipment such as, but not limited to, a heat exchanger. A representative example of driving apparatus 5 can be found in U.S. Patent Publication No. 2011/0155174 published Jun. 30, 2011, the disclosure of which is incorporated herein in its entirety. Driving apparatus 5 can be utilized to feed cleaning lance 15 to the tubes of the heat exchanger, or to retract cleaning lance 15 from the tubes of heat exchanger as desired. Storing apparatus 10 can be utilized to store cleaning lances 15, regulate the distribution and movement of cleaning lances 15, and prevent tangling or snagging of cleaning lances 15 during the cleaning process. In general, driving apparatus 5, storage apparatus 10 and cleaning lances 15 can comprise a system that can be used to clean a variety of types of pipes, tubing and equipment used in industrial facilities, in certain illustrative embodiments.

Figure 2A:
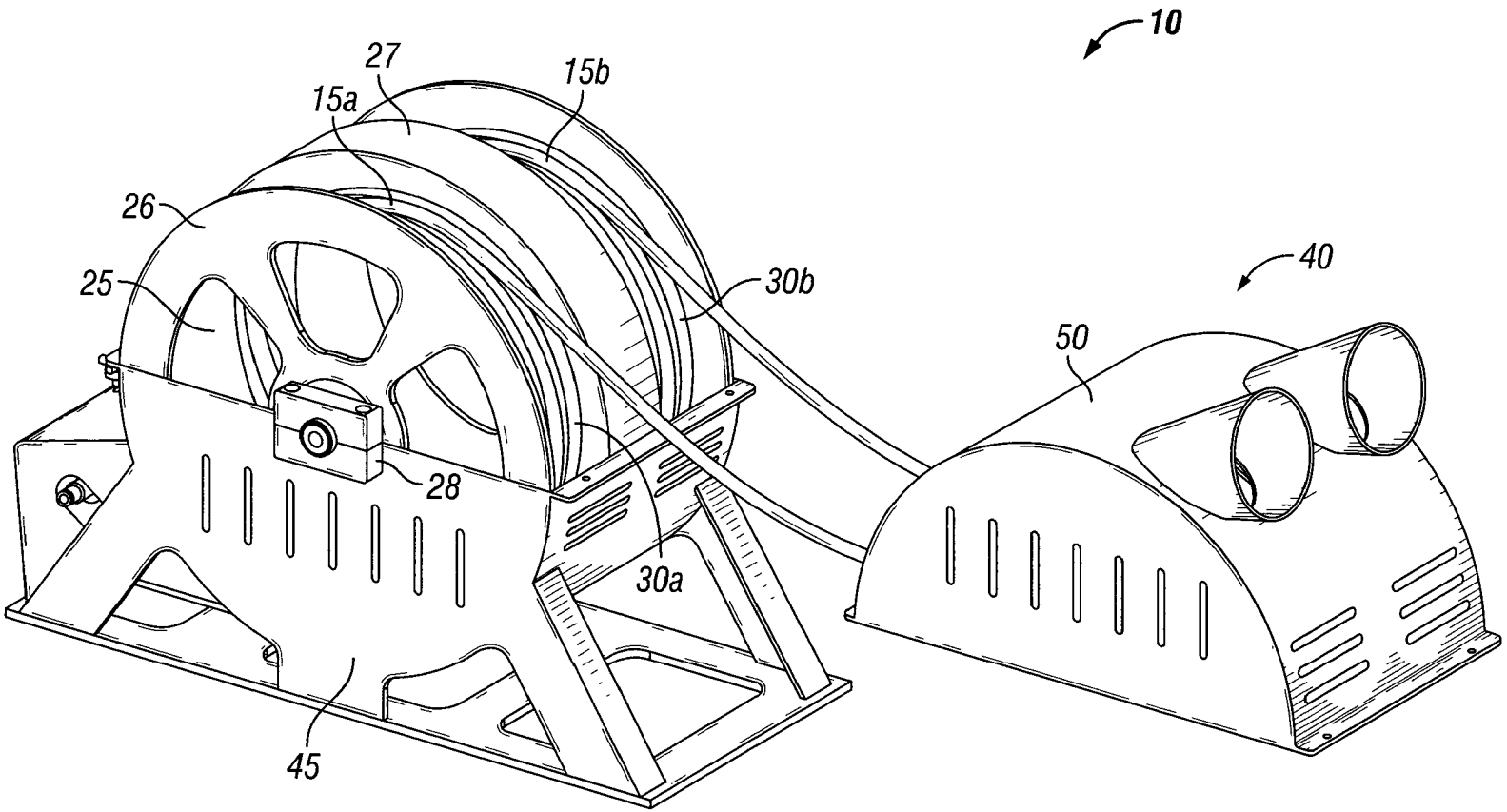
FIG. 2A is a front perspective view of a spool for a storage apparatus having a plurality of channels formed therein in an illustrative embodiment.
Figure 2B:
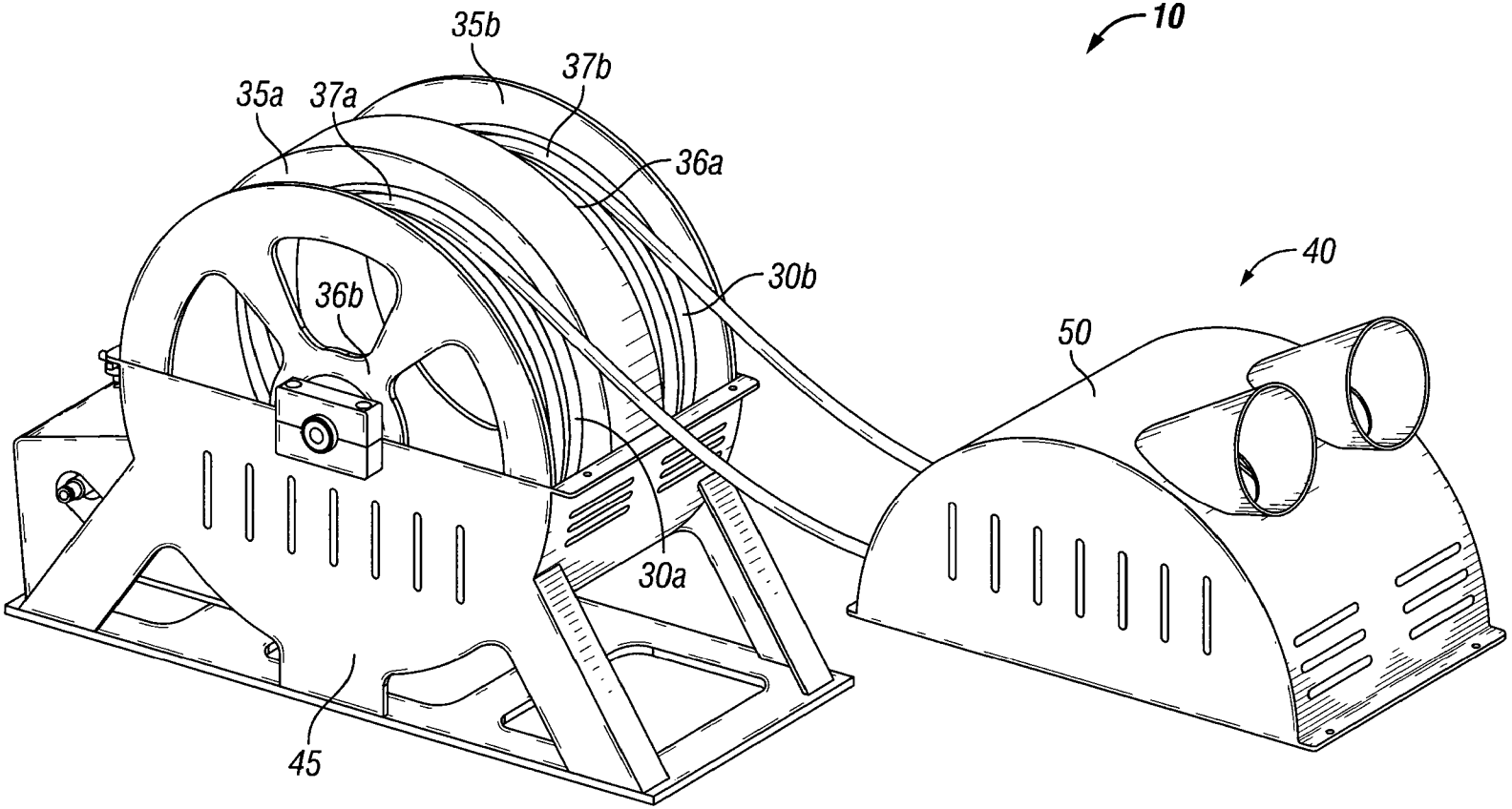
FIG. 2 is a front perspective view of a storage apparatus with the cover removed from the base in an illustrative embodiment.

In an illustrative embodiment as shown in FIG. 2, storage apparatus 10 can include a spool 25 onto which one or more cleaning lances 15 can be wound or unwound as spool 25 rotates about an axis 28. For example, spool 25 can rotate in one direction to wind cleaning lance 15 onto spool 25, or spool 25 can rotate in another opposite direction to unwind cleaning lance 15 off of spool 25.

In certain illustrative embodiments, spool 25 may have a rim 26 on its outer perimeter with an outer surface 27 disposed thereupon. One or more channels or grooves 30 may be formed within outer surface 27. Each channel 30 can hold a cleaning lance 15 therewithin, such that cleaning lance 15 is held within channel 30 as it is being wound onto, or off of, spool 25. In the illustrative embodiment of FIG. 2, apparatus 10 has two channels 30*a* and 30*b* and two cleaning lances 15*a* and 15*b*. In general, channel 30 may have a variety of shapes, such as concave, curved, circumferential, or V-shaped, so long as channel 30 is capable of holding cleaning lance 15 therewithin. In the illustrative embodiment of FIG. 2A, channel 30*a* has a pair of retaining walls 35*a*, 36*a* and a base 37*a* positioned therebetween, and channel 30*b* has a pair of retaining walls 35*b*, 36*b* and a base 37*b* positioned therebetween, such that cleaning lance 15 sits securely between retaining walls 35*a*, 36*a* and adjacent base 37*a*, and between retaining walls 35*b*, 36*b* and adjacent base 37*b*, respectively. In other embodiments, rim 26 does not need to be on the outer perimeter of spool 25 but can be in any location that allows for storage of cleaning lance on spool 25.

Figure 3:
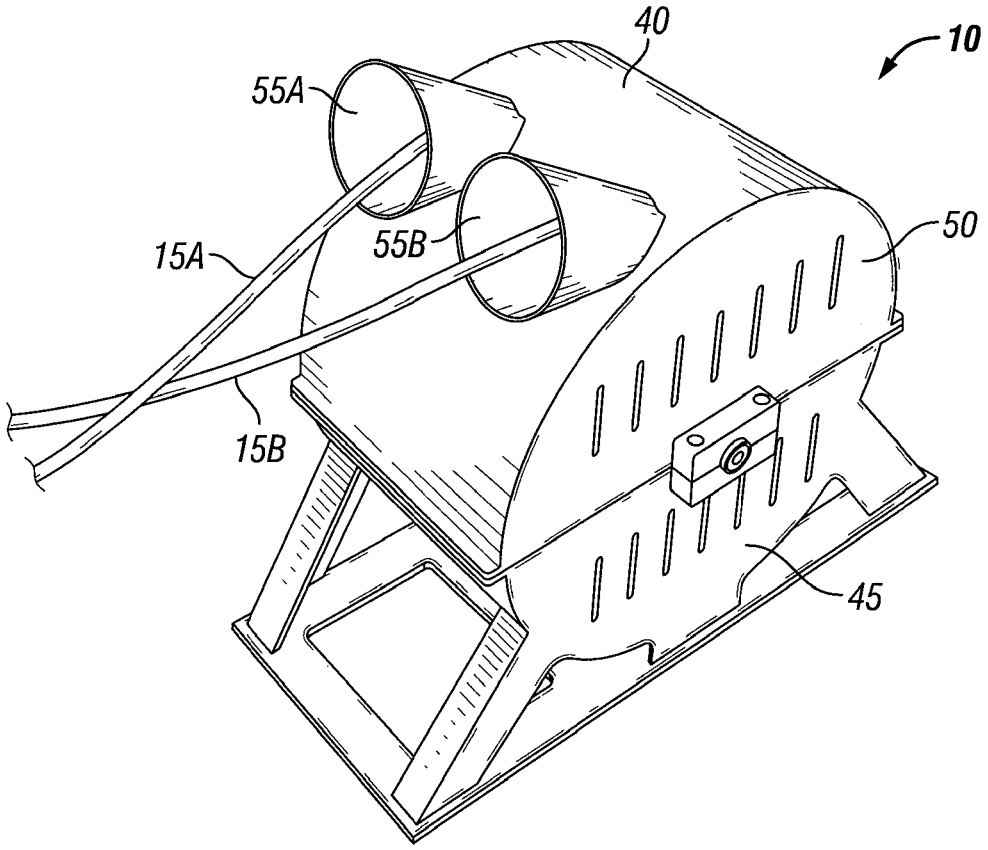
FIG. 3 is a front perspective view of a storage apparatus with the cover attached to the base in an illustrative embodiment.

In an illustrative embodiment, spool 25 can sit within an enclosure 40. For example, spool 25 can be rotatably mounted within enclosure 40 so that it revolves about an axis of rotation. Enclosure 40 can comprise a base 45 and a cover 50. As illustrated in FIGS. 2 and 3, enclosure 40 may be utilized to cover, enclose and protect spool 25 and cleaning lances 15 disposed thereon. In an illustrative embodiment, cover 50 of enclosure 40 can be removed as needed to provide access to cleaning lance 15. For example, in FIG. 2 cover 50 is removed from base 45 and enclosure 40 is in the open configuration, while in FIG. 3, cover 50 is secured onto base 45 and enclosure 40 is in the closed configuration.

In an illustrative embodiment, one or more guide apertures 55 can be formed in enclosure 40. Cleaning lance 15 can pass through guide aperture 55 as lance 15 extends or retracts with respect to apparatus 10. In the illustrative embodiment of FIG. 3, enclosure 40 has two guide apertures 55*a* and 55*b* for cleaning lances 15*a* and 15*b*, respectively. Guide apertures 55 can preferably prevent cleaning lance 15 from moving out of position or otherwise becoming tangled or disengaged from apparatus 10 during operation.

Figure 4:
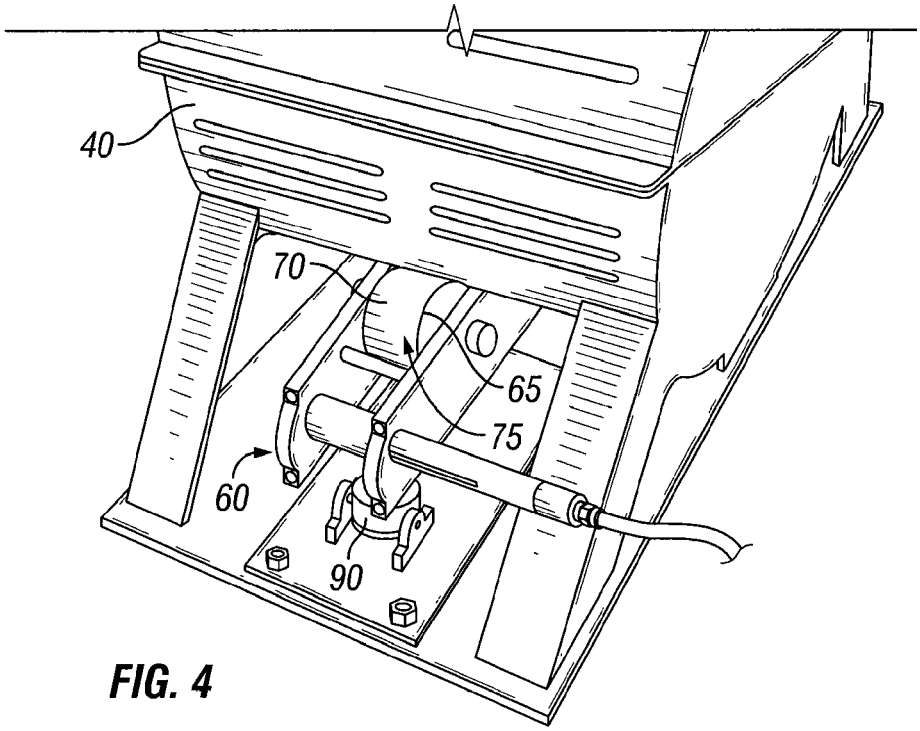
FIGS. 4-5 are front perspective views of an engagement unit for a storage apparatus in an illustrative embodiment.
Figure 5:
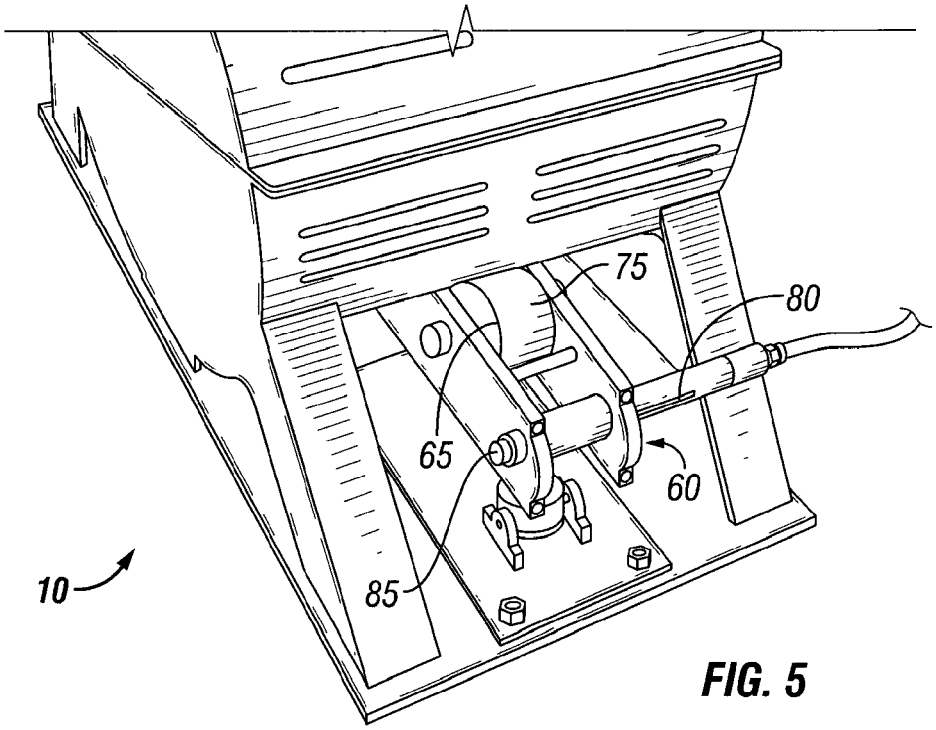
Figure 6:
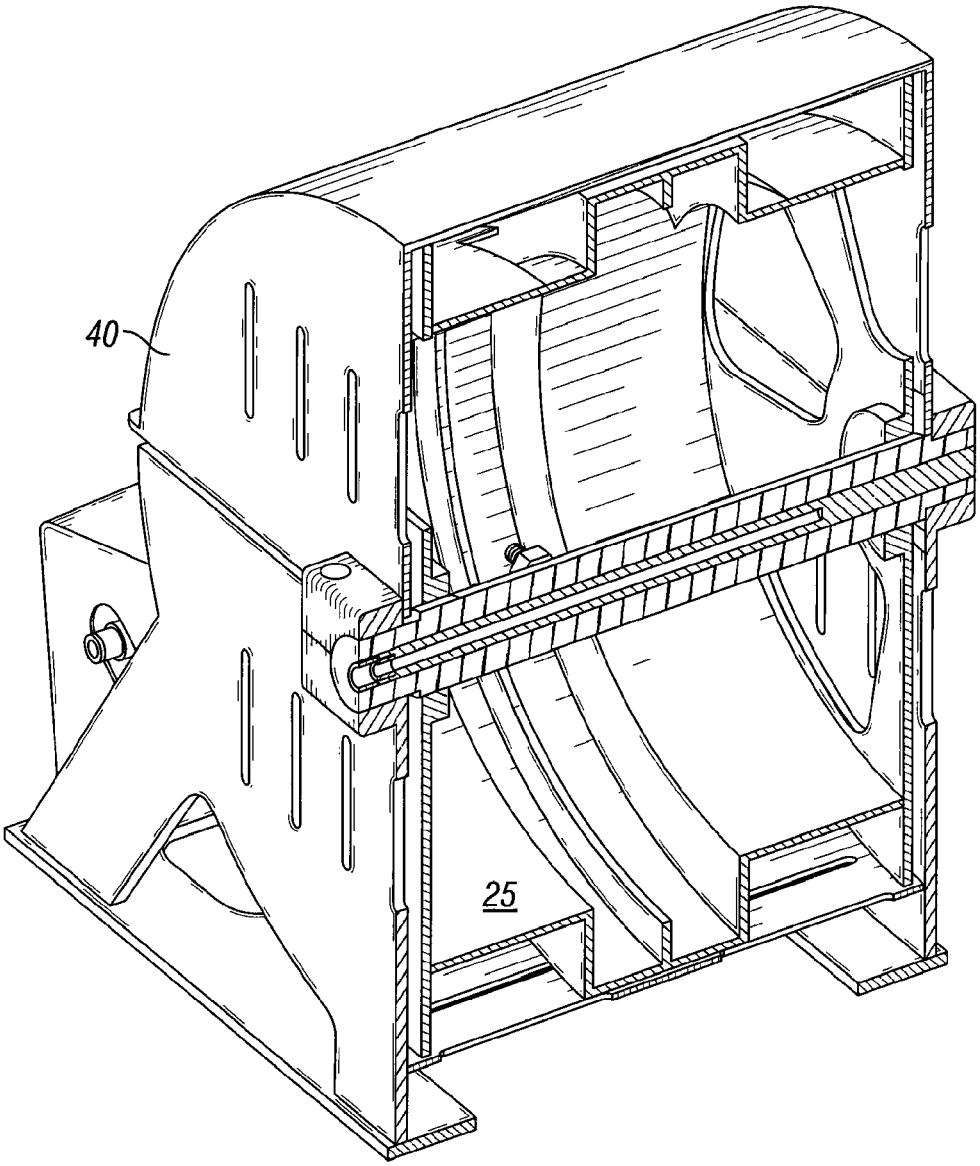
FIGS. 6-11 are various views of a storage apparatus in various illustrative embodiments.
Figure 7:
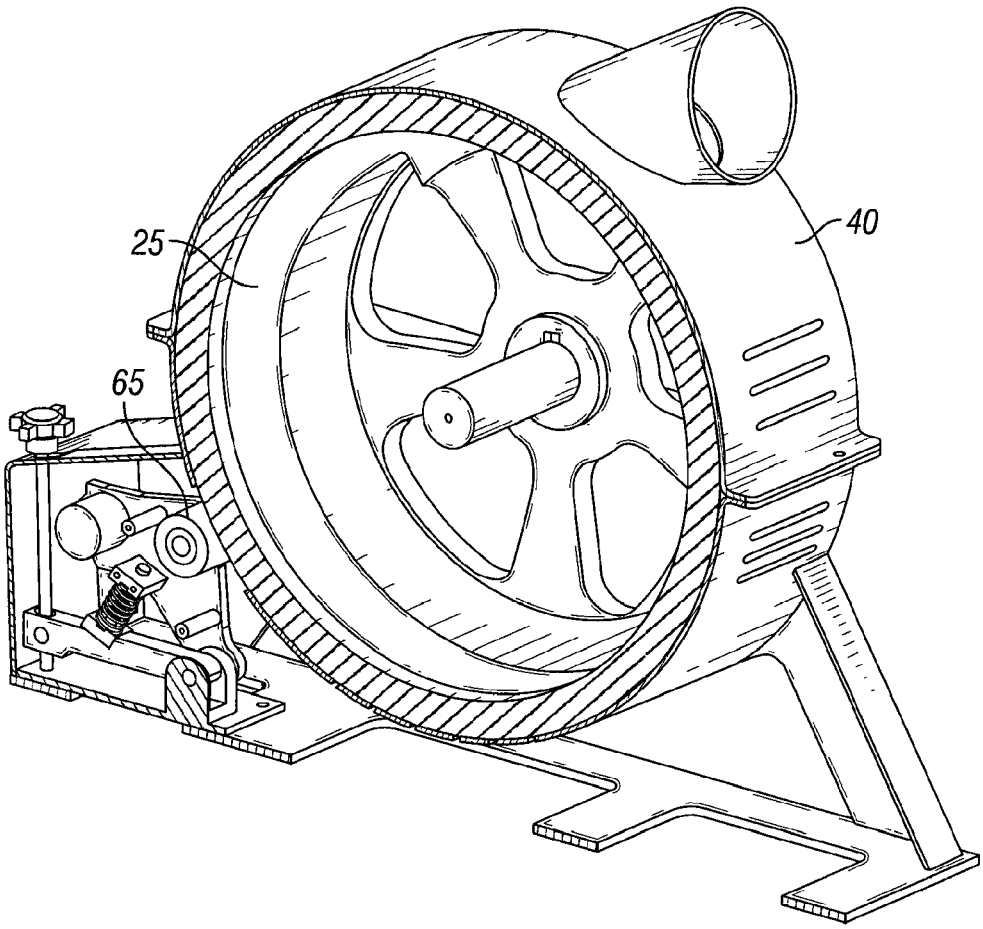
Figure 8:
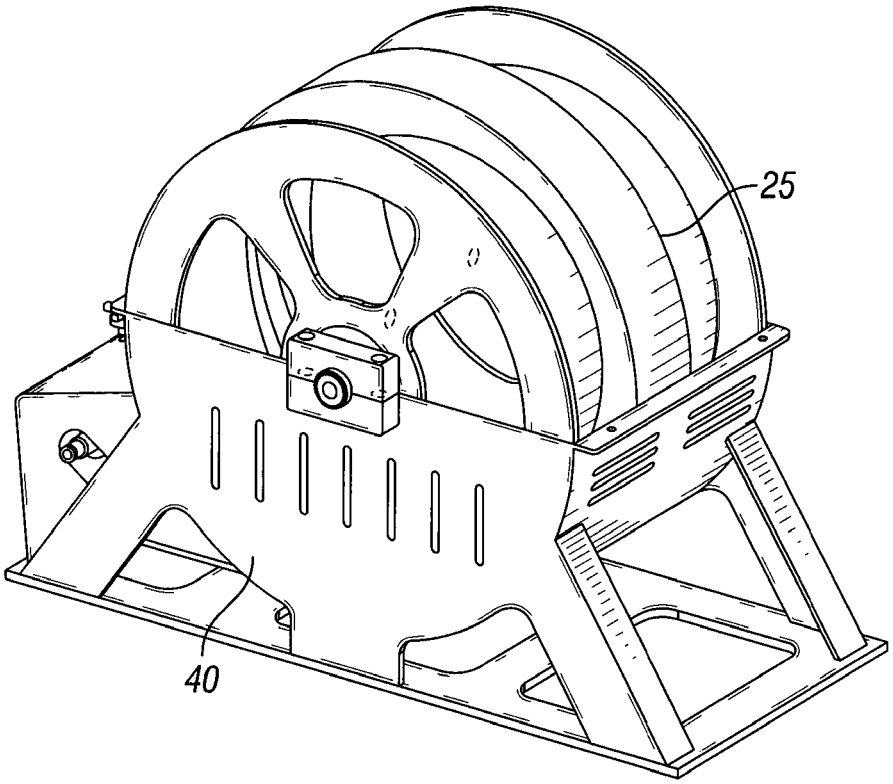
Figure 9:
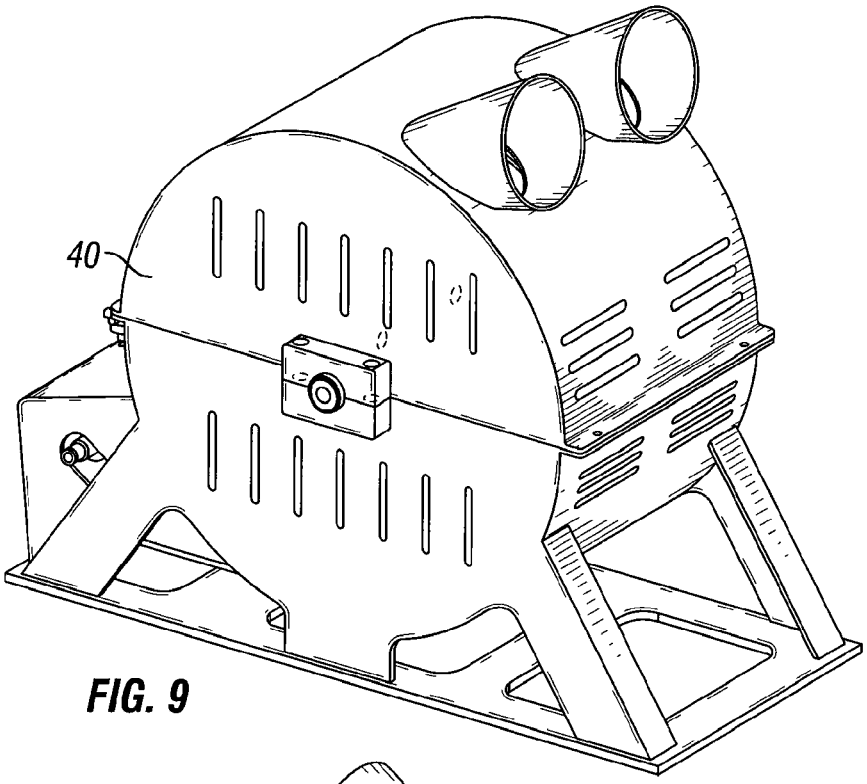
Figure 10:
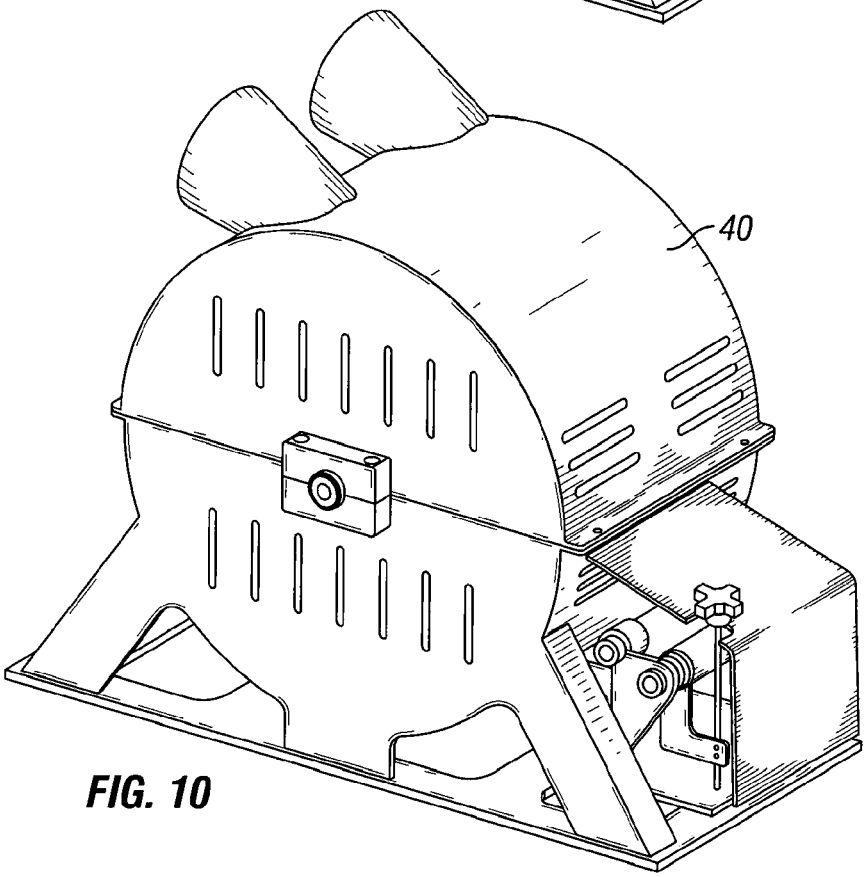
Figure 11:
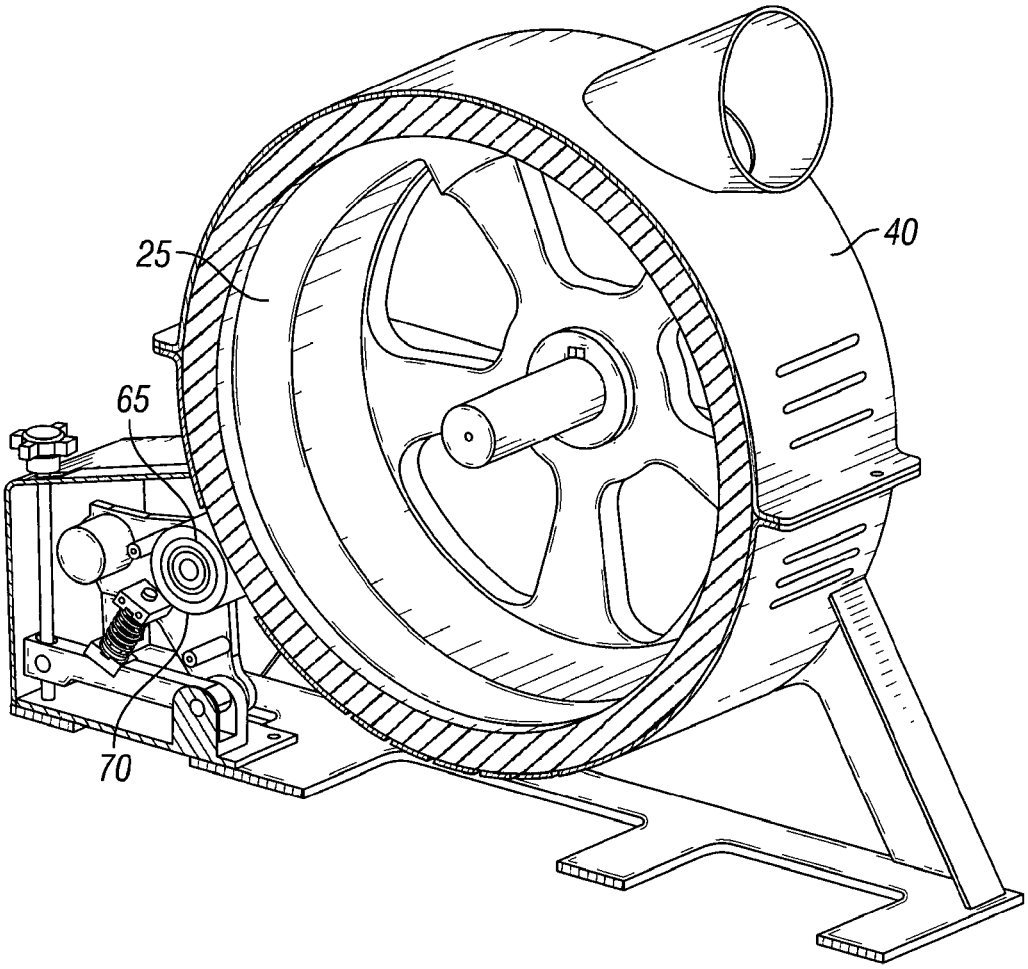

In an illustrative embodiment, apparatus 10 can also include an engagement unit 60. As illustrated in FIGS. 4 and 5, engagement unit 60 can be disposed adjacent to enclosure 40. Engagement unit 60 can include at least one engagement wheel 65 capable of rotational movement. The rotational movement of engagement wheel 65 can be powered by, for example, a motor 80 such as an air motor, or by an electrical power source or any other power source as would be understood by one of ordinary skill in the art. In certain illustrative embodiments, motor 80 can power a drive belt 85 that can drive or affect the rotation of engagement wheel 65. Engagement wheel 65 can preferably rotate in either a forward or reverse direction, as desired. In a preferred embodiment, a user of apparatus 10 can adjust and/or control the rotational speed of engagement wheel 65 (in RPMs or other suitable units) as desired.

As illustrated in FIG. 4, enclosure 40 can have a window 70 formed therein that exposes a section of spool 25. Engagement wheel 65 can be moveably positioned with respect to, and/or so that it is adjacent to, window 70. For example, engagement unit 60 can have an air powered cylinder 90 that can move engagement wheel 65 towards or away from window 70. In certain illustrative embodiments, engagement wheel 65 can be positioned so that an outer surface 75 of engagement wheel 65 can directly contact outer surface 27 of spool 25 through window 70. For example, engagement wheel 65 can contact outer surface 27 of spool 25 when engagement wheel 65 is in the "raised" or "open" position. Also, engagement wheel 65 can move away from, and not contact, outer surface 27 of spool 25 when engagement wheel 65 is in the "lowered" or "closed" position, in certain illustrative embodiments.

In certain illustrative embodiments, engagement wheel 65 can display certain desired "grip and slip" properties when it contacts spool 25. For example, engagement wheel 65 can grip outer surface 27 of spool 25 firmly enough to apply pressure to spool 25 and promote rotational movement of spool 25, but also, engagement wheel 65 can slip with respect to outer surface 27 of spool 25 if the forward or reverse movement of cleaning lance 15 somehow becomes restricted.

In an illustrative embodiment, engagement wheel 65 is capable of rotating spool 25 to retract cleaning lance 15 at the same rate that driving apparatus 5 retracts cleaning lance 15 from the tubes of the exchanger. In an illustrative embodiment, these rates are both up to thirty (30) inches per second when constant, but can vary in the range from zero (0) to thirty (30) inches per second on the instroke. In general, the speed at which lances 15*a* and 15*b* are retracted from the tubes of exchanger by driving apparatus 5 can vary based on, for example, fouling or other obstructions within the tube, slippage of lances 15 due to oil or grease, or other impediments to movement. If there is no resistance on lance 15, then engagement wheel 65 can provide a sufficient amount of torque or frictional force on spool 25 to grip spool 25 and create a constant speed retraction that is equal or substantially equal to the speed at which lance 15 is retracted from the exchanger. Alternatively, if cleaning lance 15 encounters a snag or other resistance that impairs the constant speed retraction of lance 15, then engagement wheel 65 can continue to rotate, but will preferably slip over the surface of spool 25 so that spool 25 will only rotate according to the speed at which cleaning lance 15 is being fed to apparatus 10. Thus, engagement wheel 65 will provide a sufficient amount of torque or frictional force against spool 25 to support a variable speed retraction, dependent upon the speed at which cleaning lance 15 is being fed to apparatus 10. This prevent cleaning lance 15 from becoming tangled with respect to spool 25. As cleaning lance 15 works through the resistance, engagement wheel 65 will continue to slip against spool 25 and rotate at variable speed until the resistance is removed and spool 25 can ramp up to desired full speed setting. Engagement wheel 65 can then regrip spool 25. By adjusting the tension on engagement wheel 65, a user can control the torque or frictional force of engagement wheel 65 against spool 25 to allow for control of slippage and provide enough grip so that engagement wheel 65 only slips when desired, and spool 25 does not pull on lance 15 any more than lance 15 is able to retract.

Engagement wheel 65 can have a slippery contact surface in certain illustrative embodiments. Engagement wheel 65 may be formed of compound rubber, polyethylene or other polymer material, or have a coating of such material formed thereupon, to prevent damage to spool 25 when some minimal slippage and/or friction does occur, in certain illustrative embodiments.

If a user wishes to feed cleaning lance 15 to exchanger for cleaning, the air pressure can be released from air cylinder 90, and engagement wheel 65 will move away from spool 25 thus allowing spool 25 to freewheel on the out stroke.

In certain illustrative embodiments, the control mechanisms of driving apparatus 5 and storage apparatus 10 can be linked such that, for example, when a command is given to driving apparatus 5 to retract cleaning lances 15, a simultaneous command can also be given to storage apparatus 10 to move engagement wheel 65 into the appropriate position and/or rotational speed for operation. Also, driving apparatus 5 and storage apparatus 10 can be physically connected to each other, in certain embodiments, so that storage apparatus 10 does not tip over when driving apparatus 5 pulls on cleaning lance 15.

The illustrative embodiments of storage apparatus 10 described herein advantageously provide freewheeling on the outstroke and a set amount of torque or frictional force so as to maintain a variable winding speed in the range from zero to thirty inches per second on the instroke. The torque or frictional force can be adjusted according to the operating conditions, such as high levels of oil, grease etc. The variable speed wind-up operates like a spring loaded reel but without any significant resistance on the outstroke. A spring loaded reel can wind the spring tightly while the cleaning lance is being unreeled, but as the spring winds tighter, the oils on the cleaning lance will cause significant slippage. The apparatus described herein also advantageously prevents tangled or snagged lances, and thus avoids the problem of users reaching out to handle the tangled or snagged lances which is a safety concern.

It is to be understood that the subject matter is not limited to the exact details of construction, operation, exact materials, or illustrative embodiments shown and described, as modifications and equivalents will be apparent to one skilled in the art. Accordingly, the subject matter is therefore to be limited only by the scope of the appended claims.

What is claimed is:

1. An apparatus for storing a cleaning lance, the apparatus comprising:

an enclosure;

a spool disposed within the enclosure and rotatable about an axis, the spool having a rim with a contact surface formed thereon and at least one channel formed therein for holding the cleaning lance;

an aperture formed in the enclosure and sized such that a segment of the cleaning lance is passable through the aperture; and an engagement wheel disposed adjacent to the spool and outside the enclosure with a contact surface thereon for contacting the contact surface on the rim of the spool and applying frictional force to the spool when the spool rotates about the axis, the engagement wheel being adjustable between a raised position where the contact surface of the engagement wheel contacts the contact surface of the rim and drives the spool to rotate and wind the cleaning lance onto the spool, and a lowered position where the contact surface of the engagement wheel does not contact the contact surface of the rim, the enclosure having a window formed therein such that the contact surface of the engagement wheel contacts the contact surface of the rim through the window when the engagement wheel is raised, the contact surface of the engagement wheel being capable of (i) slipping against the contact surface of the spool and continuing the rotational movement of the engagement wheel when there is a restriction to movement of the cleaning lance and (ii) regripping the contact surface of the spool upon removing or substantially removing the restriction to movement of the cleaning lance.

2. A system for retracting a cleaning lance away from a heat exchanger, the system comprising:

a cleaning lance;

a storage apparatus for storing the cleaning lance comprising an enclosure, a spool disposed within the enclosure and rotatable about an axis, the spool having a rim with a contact surface formed thereon for holding the cleaning lance, an aperture formed in the enclosure and sized such that a segment of the cleaning lance is passable through the aperture, and a motorized engagement wheel disposed adjacent to the spool with a contact surface thereon for contacting the contact surface on the rim of the spool and applying frictional force to the spool to rotate the spool about the axis, the engagement wheel being adjustable between a raised position where the contact surface of the engagement wheel contacts the contact surface of the rim and drives the spool to rotate and wind the cleaning lance onto the spool, and a lowered position where the contact surface of the engagement wheel does not contact the contact surface of the rim, the enclosure having a window formed therein such that the contact surface of the engagement wheel contacts the contact surface of the rim through the window when the engagement wheel is raised, the contact surface of the engagement wheel being capable of (i) slipping against the contact surface of the spool and continuing the rotational movement of the engagement wheel when there is a restriction to movement of the cleaning lance and (ii) regripping the contact surface of the spool upon removing or substantially removing the restriction to movement of the cleaning lance; and a motorized driving apparatus for advancing the cleaning lance in the direction of the storage apparatus.

3. A method of retracting a cleaning lance from a heat exchanger, the method comprising:

advancing the cleaning lance towards an enclosure having a spool disposed therewithin, wherein the spool is rotatable about an axis and has a rim with a contact surface formed thereon and at least one channel formed therein for holding the cleaning lance, and wherein an aperture is formed in the enclosure and sized such that a segment of the cleaning lance is passable through the aperture and capable of being guided onto the spool, and wherein an engagement wheel is disposed adjacent to the spool with a contact surface thereon for contacting the contact surface on the rim of the spool;

contacting the contact surface of the spool with the contact surface of the engagement wheel to apply frictional force to the contact surface of the spool such that the contact surface of the engagement wheel grips the contact surface of the spool and causes rotational movement of the spool;

disposing the cleaning lance onto the spool;

continuing the rotational movement of the engagement wheel while there is a restriction to movement of the cleaning lance towards the spool, such that the contact surface of the engagement wheel slips against the contact surface of the spool;

removing or substantially removing the restriction to movement of the cleaning lance;

applying frictional force to the contact surface of the spool with the engagement wheel such that the contact surface of the engagement wheel regrips the contact surface of the spool; and further disposing the cleaning lance onto the spool.

4. A method of retracting a cleaning lance, the method comprising:

advancing the cleaning lance towards a spool disposed within an enclosure and rotatable about an axis, the spool having a rim with a contact surface formed thereon and at least one channel formed therein for holding the cleaning lance, the enclosure having a complementary shape to the spool, wherein an aperture is formed in the enclosure and sized such that a segment of the cleaning lance is passable through the aperture and capable of being guided onto the spool; and wherein an engagement wheel is disposed adjacent to the spool with a contact surface thereon for contacting the contact surface on the rim of the spool;

upon rotational movement of the spool, contacting the contact surface of the spool with the contact surface of the engagement wheel to apply frictional force to the contact surface of the spool and grip the contact surface of the spool;

wrapping the cleaning lance around the spool;

continuing the rotational movement of the spool while there is a restriction to movement of the cleaning lance, such that the contact surface of the spool slips against the contact surface of the engagement wheel;

removing or substantially removing the restriction to movement of the cleaning lance;

applying frictional force to the spool upon rotational movement of the spool such that the contact surface of the engagement wheel regrips the contact surface of the spool; and further wrapping the cleaning lance around the spool.

* * * * *